US007917994B2

(12) United States Patent
Bai

(10) Patent No.: US 7,917,994 B2
(45) Date of Patent: Apr. 5, 2011

(54) HINGE FOR A GLASS DOOR

(76) Inventor: Baokun Bai, DongGuan (CN)

( * ) Notice: Subject to any disclaimer, the term of this patent is extended or adjusted under 35 U.S.C. 154(b) by 336 days.

(21) Appl. No.: 12/289,561

(22) Filed: Oct. 30, 2008

(65) Prior Publication Data

US 2009/0106937 A1 Apr. 30, 2009

(30) Foreign Application Priority Data

Oct. 31, 2007 (CN) ..... 2007 2 0302103 U

(51) Int. Cl.
*E05D 5/02* (2006.01)

(52) U.S. Cl. ..... 16/252; 16/334; 16/382

(58) Field of Classification Search ..... 16/252, 16/235, 238, 240, 241, 245, 382, 334; 49/397–399, 49/381; 160/199, 206, 208, 210, 213; 4/556, 4/557, 607, 614

See application file for complete search history.

(56) References Cited

U.S. PATENT DOCUMENTS

| | | | | |
|---|---|---|---|---|
| 5,867,871 | A * | 2/1999 | Tasman | 16/335 |
| 6,704,966 | B1 * | 3/2004 | Kao | 16/252 |
| 6,766,561 | B1 * | 7/2004 | Cheng | 16/235 |
| 2002/0144377 | A1 * | 10/2002 | Cheng | 16/252 |
| 2005/0071952 | A1 * | 4/2005 | Chen | 16/252 |
| 2005/0125949 | A1 * | 6/2005 | Lin | 16/248 |

FOREIGN PATENT DOCUMENTS

| | | | |
|---|---|---|---|
| EP | 599254 | A1 * | 6/1994 |
| EP | 792990 | A1 * | 9/1997 |
| EP | 867586 | A2 * | 9/1998 |
| FR | 2907488 | A1 * | 4/2008 |
| WO | WO 2004085780 | A1 * | 10/2004 |

* cited by examiner

*Primary Examiner* — Chuck Y. Mah
(74) *Attorney, Agent, or Firm* — Rosenberg, Klein & Lee

(57) ABSTRACT

The present invention is to provide a hinge suitable for a glass door, having a roller actuating by a spring member and cooperating with a cylindrical surface and slots on the cylindrical surface to hold the glass door in the opened and closed positions, and to make the fluent opening and closing movement of the glass door.

9 Claims, 5 Drawing Sheets

HINGE FOR A GLASS DOOR

FIELD OF THE INVENTION

The present invention relates to a hinge, particularly but not exclusively relates to a hinge for a glass door.

BACKGROUND OF THE INVENTION

A glass door can be mounted in a doorframe universally by using hinges to provide a light-admitting and waterproof circumstance in public or at home. There are a variety of structures of glass door hinges.

SUMMARY OF THE INVENTION

The object of the present invention is to provide a hinge suitable for a glass door, having a roller actuating by a spring member and cooperating with a cylindrical surface and slots on the cylindrical surface to hold the glass door in the opened and closed positions, and to make the fluent opening and closing movement of the glass door.

To accomplish this object, the present invention is characterized by a hinge for a glass door comprising: a first clamp member having a first recess, a spring slot in the inside surface of the first clamp member, and a roller receiving hole in the side surface of the spring slot communicating with the first recess; a second clamp member fastened to the first clamp member to provide a glass pane receiving space and having a second recess corresponding to the first recess; a leaf spring received in the spring slot of the first clamp member; a positioning member received in the roller receiving hole and connected to the leaf spring, the end of which pass through the roller receiving hole into the first recess by urging of the leaf spring; a pivot bracket mounted on a doorframe and received in the first recess and the second recess and having a cylindrical out surface corresponding to the positioning member and pressed against the positioning member and having a plurality of positioning slot on the cylindrical out surface corresponding to the positioning member; and a pivot pin by which the first clamp member is hinged to the pivot bracket.

It is particularly preferred that a gear is defined on one end of the pivot pin, the first clamp member having a pair of pivot holes in the two side surface of the recess and a gear ring in the pivot hole, the gear going into mesh with the gear ring when the first clamp member is hinged to the pivot bracket by the pivot pin extending therethrough.

It is particularly preferred that the first clamp member has a notch and a fastening panel covering the open side of the notch to form the spring slot.

It is particularly preferred that a roller-mounting hole is defined in the leaf spring and a spring-mounting hole is defined in the positioning member corresponding to the roller-mounting hole, the leaf spring and the positioning member being interconnected by a bolt screwing respectively into the roller-mounting hole and the spring-mounting hole.

It is particularly preferred that a through hole is defined in the side surface of the spring slot corresponding to the roller receiving hole.

It is particularly preferred that the positioning member is pressed and urged by the leaf spring.

It is particularly preferred that the positioning member comprises: a connecting post; a roller bracket extending from the connecting post; and a roller, hinged to the roller bracket, the end of which passes through the roller receiving hole into the first recess by urging of the leaf spring.

It is particularly preferred that the pivot bracket has three the positioning slots at intervals of 90 degrees on the cylindrical out surface.

It is particularly preferred that the hinge further comprises a mounting base fastened on the pivot bracket and mounted securely on the doorframe.

DESCRIPTION OF THE PREFERRED EMBODIMENT

Figure 1A:
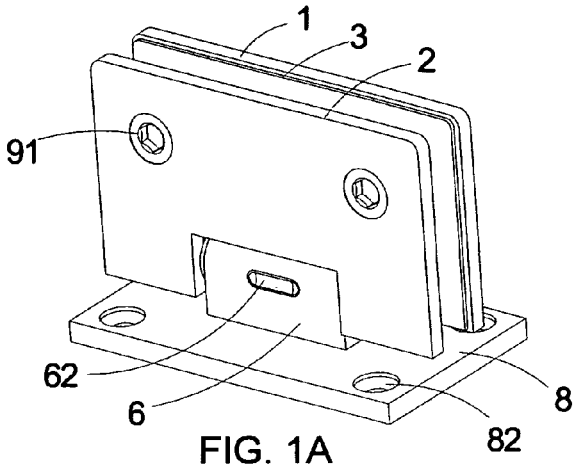
FIG. 1A is a perspective view of a hinge for a glass door of a first example according to the present invention.
Figure 1B:
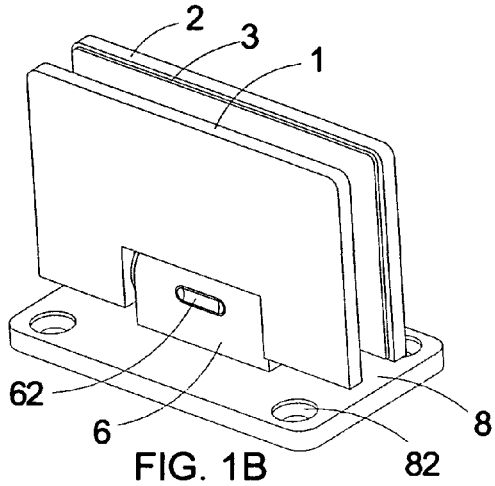
FIG. 1B is a perspective view, looking from another perspective, of the hinge for the glass door of the first example according to the present invention.
Figure 1C:
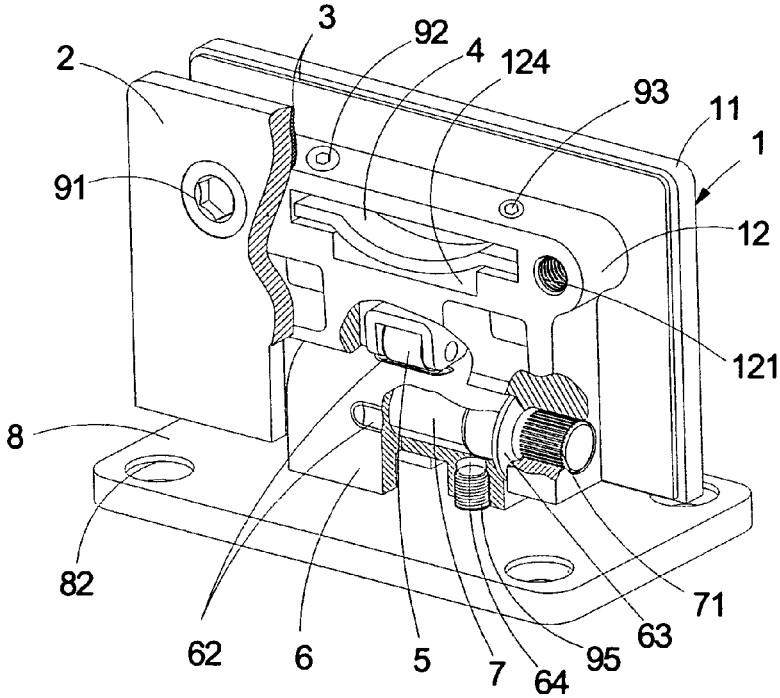
FIG. 1C is a perspective view, partly broken away, of the hinge for the glass door of the first example according to the present invention.
Figure 1D:
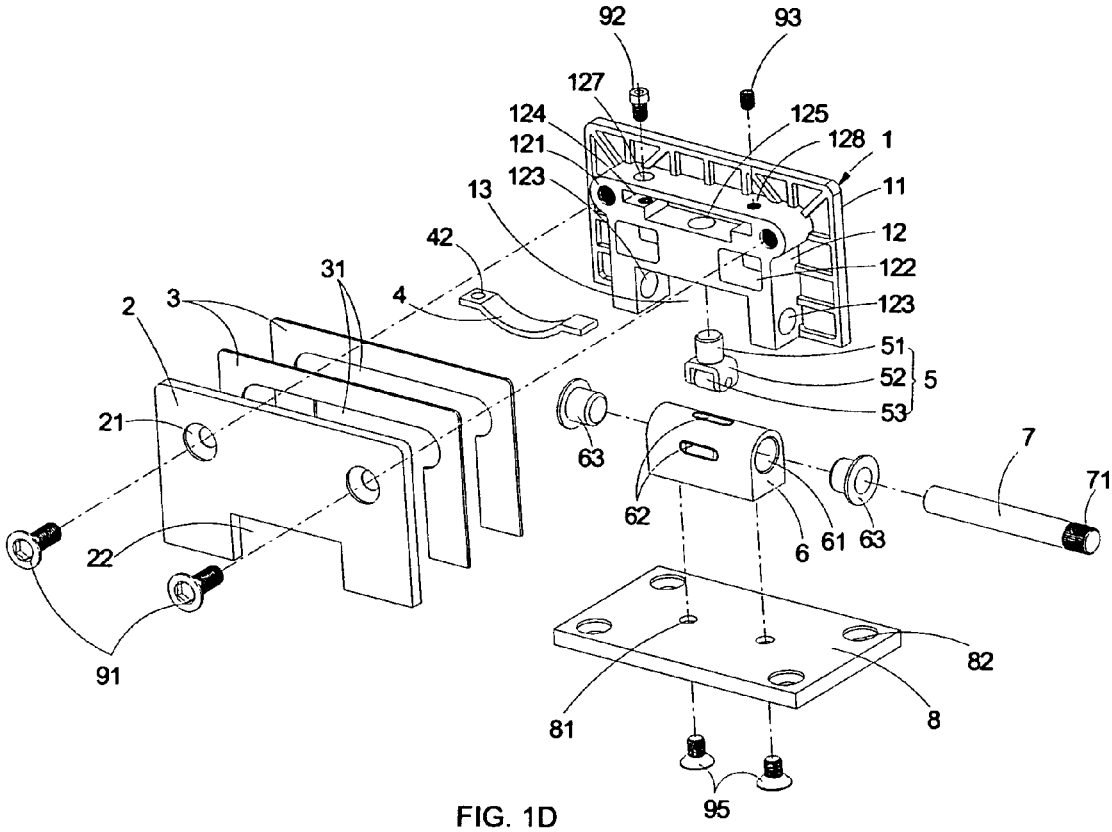
FIG. 1D is an exploded perspective view of the hinge for the glass door of the first example according to the present invention.

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner.

Example 1

As shown in the FIGS. 1A-1D, a first preferred embodiment is described as below.

A hinge for a glass door comprises a first clamp member 1, a second clamp member 2, two gasket 3, a leaf spring 4, a positioning member 5, a pivot bracket 6, a pivot pin 7 and a mounting base 8.

The first clamp member 1 has a clamp plate 11 and a connecting block 12 interconnected. The clamp plate 11 has a platelike structure. The connecting block 12 is smaller in diameter than the clamp plate 11 and is extending backwards from the back surface of the clamp plate 11. A first recess 13 is defined in the bottom end of the clamp plate 11 and the connecting block 12. The first recess 13 has a pair of pivot hole 123 in the two side surfaces thereof respectively. Two threaded clamp holes 121 are defined in the back surface of the top portion of the connecting block 12. A "T"-shaped spring slot 124 is defined between the threaded clamp holes 121 in the back surface of the top portion of the connecting block 12. A mounting hole 127 and a pressing hole 128 are defined in the top surface of the connecting block 12 corresponding to the two ends of the spring slot 124 and communicating with the spring slot 124. The mounting hole 127 passes through the top and bottom wall of the spring slot 124. The pressing hole 128 only passes through only the top wall of the spring slot 124. A roller receiving hole 125 is defined in the middle of the bottom surface of the spring slot 124, passing through the portion of the connecting block 12 below the spring slot 124, communicating with the recess 122. A rectangular hole 122 is defined in the back surface of the connecting block 12, below the two ends of the spring slot 124 and above the first recess 13, which is provide the economy of manufacture material.

The second clamp member 2 is a clamp plate which has the same size of the first clamp member 1. A second recess 22 is defined in the bottom of the second clamp member 2 corresponding to and communicating with the first recess 13 of the first clamp member 1. A through hole 21 is defined in the second clamp member 2 corresponding to the threaded clamp hole 121 of the connecting block 12. The second clamp member 2 is fattened on the connecting block 12 of the first clamp member 1 by a bolt 91 passing through the through hole 21 and screwing into the threaded clamp hole 121. The bolt 91 use an allen countersunk head screws.

The gaskets 3 are made of nylon. The gasket 3 has the similar shape and size with the clamp plate 11 of the first clamp member 1 and second clamp member 2. The gasket 3 has a notch 31 corresponding to the connecting block 12 of the first clamp member 1. The gaskets 3 are mounted around the connecting block 12 respectively adjacent to the clamp plate 11 and the second clamp member 2.

A glass pane (not shown) can be clamped between the clamp plate 11 of the first clamp member 1 and the second clamp member 2 of the hinge after being notched out to receive the connecting block 12 of the first clamp member 1. Two gaskets 3 are mounted between the glass pane and the clamp plate 11, the second clamp member 2 respectively. Thus, the hinge is mounted on the glass pane.

The leaf spring 4 is received in the spring slot 124 of the connecting block 12 of the first clamp member 1. A spring-mounting hole 42 is defined in one end of the leaf spring 4 corresponding to the mounting hole 127 of the connecting block 12. By a bolt 92 screwing into the mounting hole 127 and the spring-mounting hole 42, one end of the leaf spring 4 is mounted in the spring slot 124 securely. A bolt 93 screws into the pressing hole 128 and presses the other end of the leaf spring 4. The bolt 92 use an allen sunk screw, and the bolt 93 use a holding screws.

The positioning member 5 has a connecting post 51, a roller bracket 52 and a roller 53. The connecting post 51 corresponds with the roller receiving hole 125 of the connecting block 12. The roller bracket 52 extends downwards from the connecting post 51. The roller 53 is hinged to the roller bracket 52. The bottom of the roller 53 passes through the roller receiving hole 125 into the first recess 13 by the press of the leaf spring 4.

The pivot bracket 6 has a half-cylindrical top portion and a cuboid bottom portion. The pivot bracket 6 is received in the first recess 13 of the first clamp member 1 and the second recess 22 of the second clamp member 2. The cylindrical surface of the pivot bracket 6 is pressed against the roller 53. The pivot bracket 6 has a bore 61. Two bushings 63 are mounted respectively in the two ends of the bore 61. The pivot bracket 6 has three positioning slot 62 at intervals of 90 degrees, i.e in the 9, 12, 3 o'clock position, on the cylindrical surface. The pivot bracket 6 has two bracket mounting holes 64 on the bottom thereof.

A gear 71 is defined on one end of the pivot pin 7. The connecting block 12 has a pair of pivot holes 123 on two side surface of the recess 13 and a gear ring (not shown) on the side surface of each of the pivot holes 123 respectively. When the first clamp member 1 is hinged to the pivot bracket 6 by the pivot pin 7 extending through the pivot holes 123 and the bore 61, the gear 71 goes into mesh with the gear ring to prevent the rotation of the pivot pin 7 relative to the first clamp member 1 and the glass door, i.e. the second clamp member 2, the first clamp member 1 and the glass door pane move at the same time. When the first clamp member 1 and the glass door pane turned relative to the pivot bracket 6, the cylindrical out surface of the pivot bracket 6 is urged by the roller 53. During the turning of the glass door, the roller 53 will inserted into the three positioning slots 62 in the proper order, i.e locate at the inwards opened position, the closed position and the outwards opened position.

Two through holes 81 are defined in the mounting base 8 corresponding to the bracket mounting holes 64 in the pivot bracket 6. The pivot bracket 6 is fastened to the mounting base 8 by a plurality of bolts screwing into the through holes 81 and the bracket mounting holes 64. The mounting base 8 is also fastened to the doorframe by four bolts screwing into four through holes 82 in the corners of the base 8 and the holes in the doorframe.

Example 2

Figure 2A:
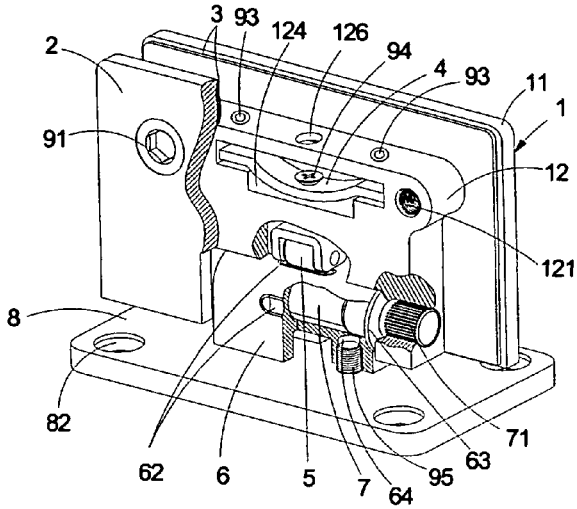
FIG. 2A is a perspective view, partly broken away, of a hinge for a glass door of a second example according to the present invention.
Figure 2B:
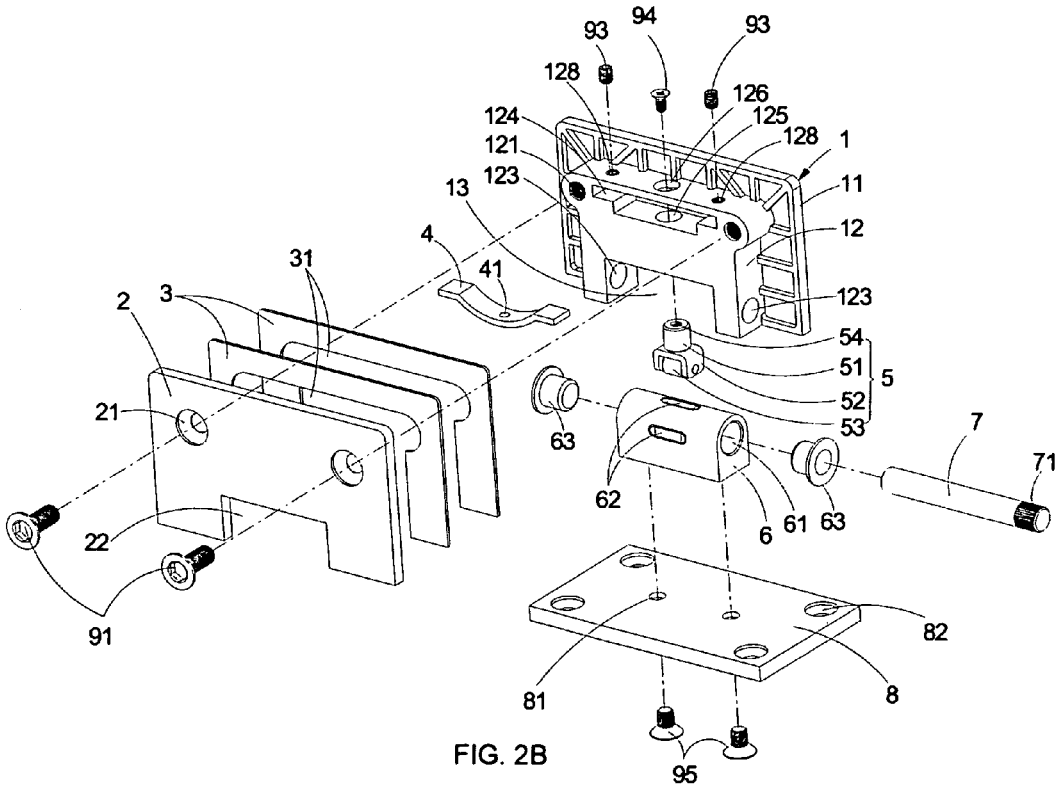
FIG. 2B is an exploded perspective view of the hinge for the glass door of the second example according to the present invention.

As shown in FIGS. 2A-2B, a second preferred embodiment of the hinge for the glass door of the present invention is schematically depicted. The components thereof same as or similar to those of the first preferred embodiment in FIGS. 1A-1D use the same numerals.

The second preferred embodiment differs from the first preferred embodiment only as follows:

The leaf spring 4 has a through roller-mounting hole 41 in the middle thereof corresponding to the roller receiving hole 125 of the connecting block 12. A spring-mounting hole 54 is defined in the top surface of the connecting post 51 of the positioning member 5 corresponding to the roller-mounting hole 41. The leaf spring 4 is connected to the positioning member 5 by a bolt 94 screwing into the roller-mounting hole 41 and the spring-mounting hole 54 respectively. The bolt 94 uses a cross recessed countersunk head screw. For the convenience of the installation of the leaf spring 4 and the positioning member 5, a through hole 126 is defined in the top surface of the connecting block 12 corresponding to the roller receiving hole 125 and communicating with the spring slot 124 to provide a passage for the bolt 94.

Two pressing holes 128 are defined in the top surface of the connecting block 12 communicating with the spring slot 124. Two ends of leaf spring 4 do not have the spring-mounting hole 42. The leaf spring 4 is mounted in the spring slot 124 by the bolts 93 screwing into the pressing holes 128 and pressing the two ends of the leaf spring 4 securely. The bolts 93 use holding screws.

Example 3

Figure 3A:
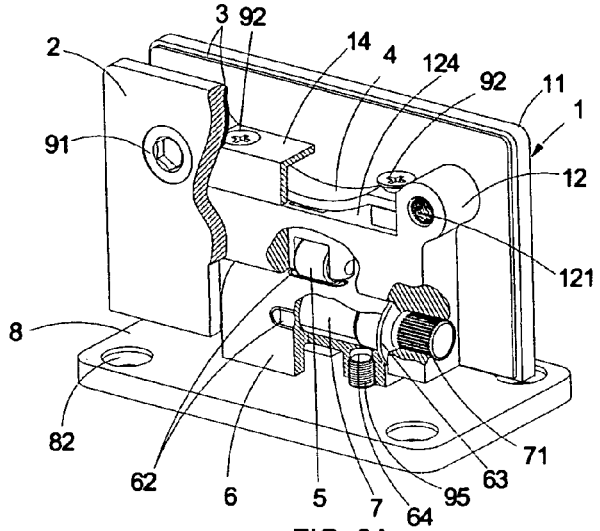
FIG. 3A is a perspective view, partly broken away, of a hinge for a glass door of a third example according to the present invention.
Figure 3B:
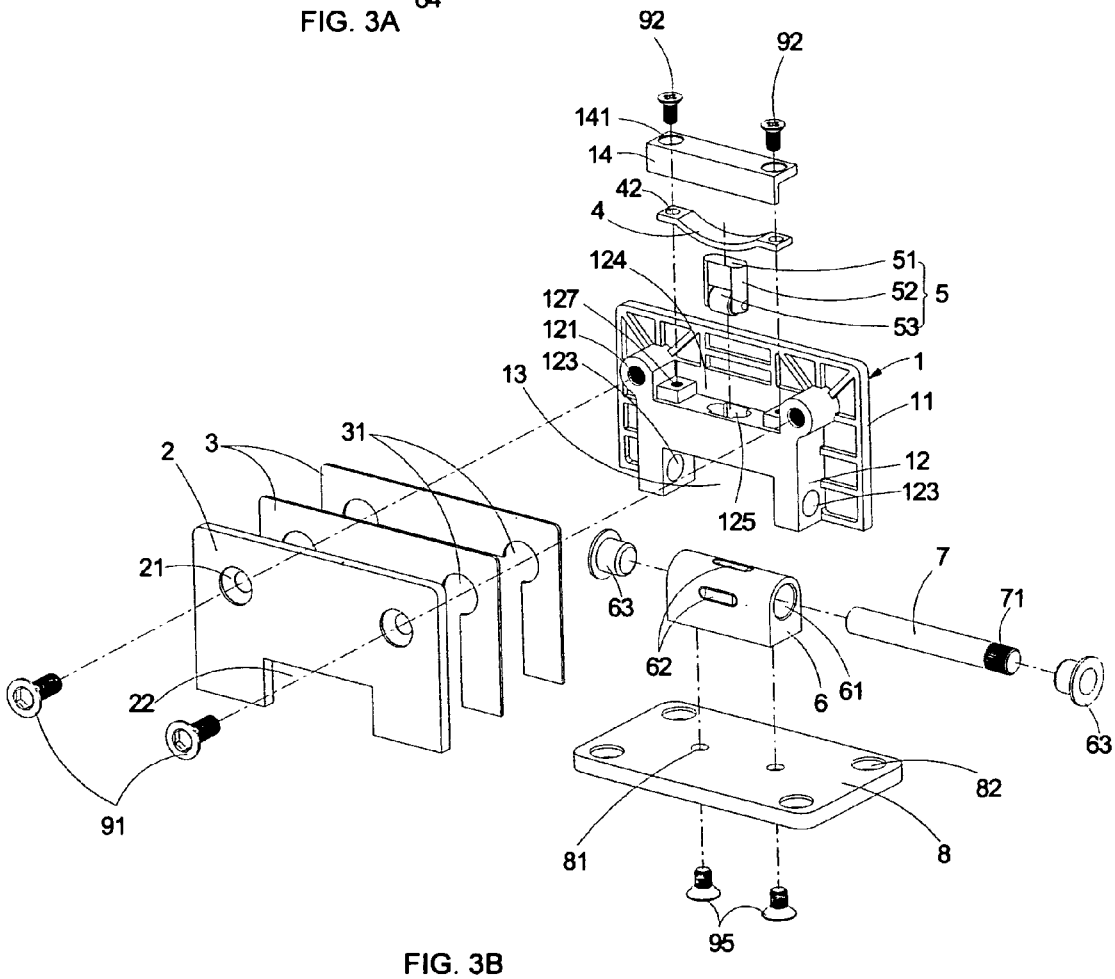
FIG. 3B is an exploded perspective view of the hinge for the glass door of the third example according to the present invention.

As shown in FIGS. 3A-3B, a third preferred embodiment of the hinge for the glass door of the present invention is schematically depicted. The components thereof same as or similar to those of the first preferred embodiment use the same numerals.

The third preferred embodiment differs from the first preferred embodiment only as follows:

The connecting block 12 has a notch in the top thereof and a fastening panel 14 covering the open side of the notch to form the spring slot 124. Two threaded holes 127 are defined in the bottom surface of the spring slot 124 of the connecting block 12. The fastening panel 14 has two through holes 141 corresponding to the holes 127 respectively. Each end of the leaf spring 4 has a spring-mounting hole 42 respectively corresponding to the holes 127. By bolts 92 screwing into the holes 141, the spring-mounting holes 42 and the holes 127, the fastening panel 14 is fastened on the connecting block 12, and the leaf spring 4 is mounted in the spring slot 124 at the same time. The bolt 92 uses a cross recessed countersunk head screw.

Example 4

Figure 4A:
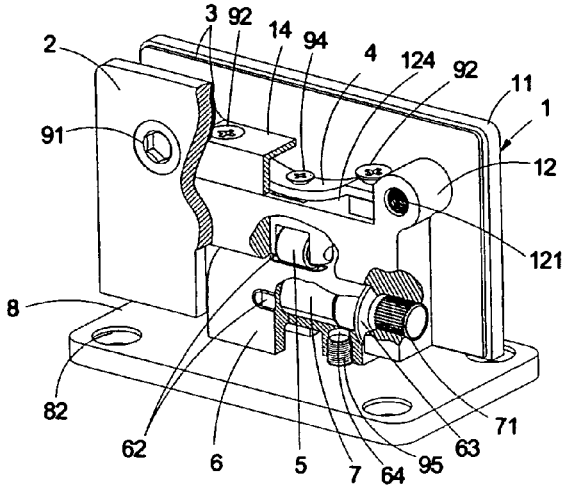
FIG. 4A is a perspective view, partly broken away, of a hinge for a glass door of a fourth example according to the present invention.
Figure 4B:
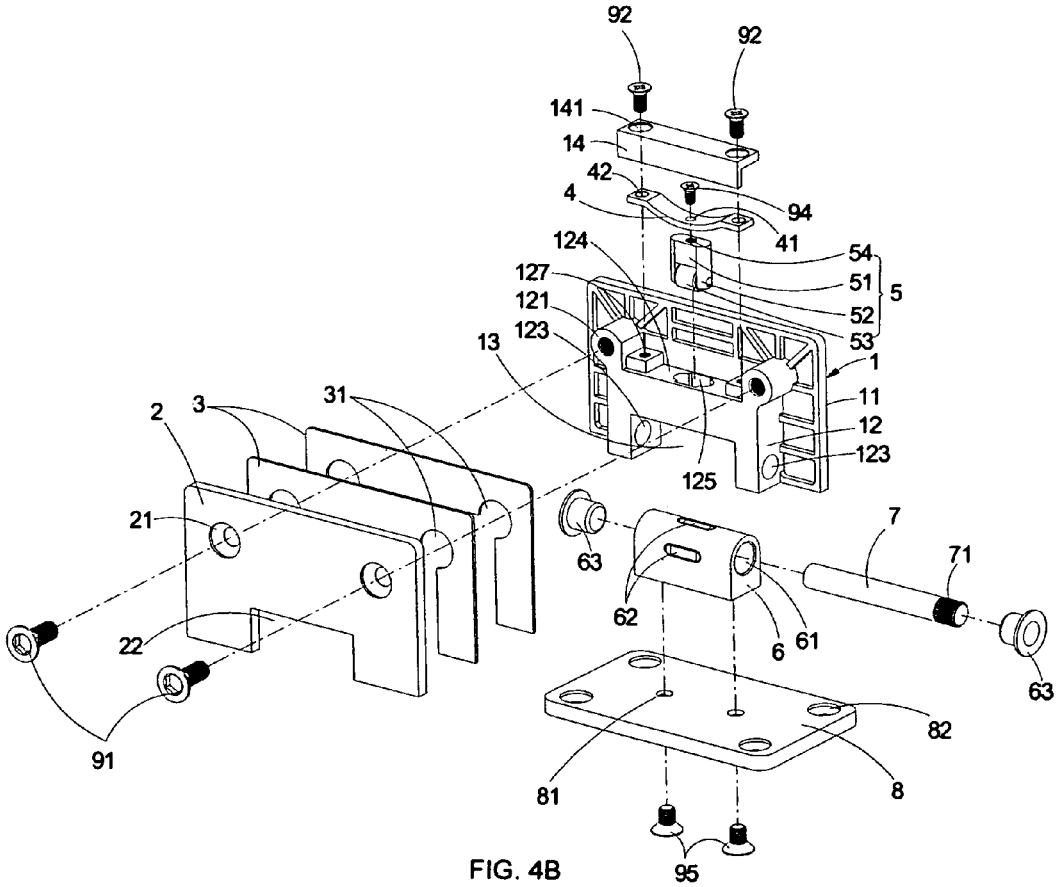
FIG. 4B is an exploded perspective view of the hinge for the glass door of the fourth example according to the present invention.

As shown in FIGS. 4A-4B, a fourth preferred embodiment of the hinge for the glass door of the present invention is schematically depicted. The components thereof same as or similar to those of the first preferred embodiment use the same numerals.

The fourth preferred embodiment differs from the third preferred embodiment only as follows:

A roller-mounting hole 41 is defined in the middle portion of the leaf spring 4 corresponding to the roller receiving hole 125 of the connecting block 12. A spring-mounting hole 54 is defined in the top surface of the connecting post 51 of the positioning member 5 corresponding to the roller-mounting hole 41. The leaf spring 4 is connected to the positioning member 5 by a bolt 94 screwing into the roller-mounting hole 41 and the spring-mounting hole 54. The bolt 94 use a cross recessed countersunk head screw.

Example embodiments being thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A hinge for a glass door comprising:

a first clamp member having a first recess;

a spring slot in an inside surface of said first clamp member; and a roller receiving hole in a side surface of said spring slot, communicating with said first recess;

a second clamp member, fastened to said first clamp member to provide a glass pane receiving space, having a second recess corresponding to said first recess;

a leaf spring, received in said spring slot of said first clamp member;

a positioning member, received in said roller receiving hole and connected to said leaf spring, the end of which pass through said roller receiving hole into said first recess by urging of said leaf spring;

a pivot bracket, adapted to be mounted on a doorframe, received in said first recess and said second recess, having a cylindrical out surface corresponding to said positioning member and pressed against said positioning member, having a plurality of positioning slot on said cylindrical out surface corresponding to said positioning member; and a pivot pin, by which said first clamp member is hinged to said pivot bracket.

2. The hinge as claimed in claim 1, wherein a gear is defined on one end of said pivot pin, said first clamp member having a pair of pivot holes in two side surfaces of said recess and a gear ring in at least one of said pivot holes, said gear going into mesh with said gear ring when said first clamp member is hinged to said pivot bracket by said pivot pin extending therethrough.

3. The hinge as claimed in claim 1, wherein said first clamp member has a notch and a fastening panel covering an open side of said notch to form said spring slot.

4. The hinge as claimed in claim 1, wherein a roller-mounting hole is defined in said leaf spring and a spring-mounting hole is defined in said positioning member corresponding to said roller-mounting hole, said leaf spring and said positioning member being interconnected by a bolt screwing respectively into said roller-mounting hole and said spring-mounting hole.

5. The hinge as claimed in claim 4, wherein a through hole is defined in the side surface of said spring slot corresponding to said roller receiving hole.

6. The hinge as claimed in claim 1, wherein said positioning member is pressed and urged by said leaf spring.

7. The hinge as claimed in claim 1, wherein said positioning member comprises:

a connecting post;

a roller bracket extending from said connecting post; and a roller, hinged to said roller bracket, the end of which passes through said roller receiving hole into said first recess by urging of said leaf spring.

8. The hinge as claimed in claim 1, wherein said pivot bracket has three said positioning slots at intervals of 90 degrees on said cylindrical out surface.

9. The hinge as claimed in claim 1, further comprising a mounting base fastened on said pivot bracket and adapted to be mounted securely on said doorframe.

* * * * *